US007428789B2

(12) United States Patent
Holzer et al.

(10) Patent No.: US 7,428,789 B2
(45) Date of Patent: Sep. 30, 2008

(54) SPORTS SHOE FOR RUNNING OR CROSS-COUNTRY SKIING

(75) Inventors: Helmut Holzer, St. Johann (AT); Michael Bretz, Eben (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 223 days.

(21) Appl. No.: 11/347,677

(22) Filed: Feb. 3, 2006

(65) Prior Publication Data

US 2007/0011913 A1 Jan. 18, 2007

(30) Foreign Application Priority Data

Feb. 4, 2005 (AT) ..... A 185/2005

(51) Int. Cl.
*A43B 5/00* (2006.01)

(52) U.S. Cl. ..... 36/88; 36/93; 36/117.2; 36/117.6; 36/50.1; 36/50.5

(58) Field of Classification Search ..... 36/88, 36/93, 117.2, 117.6, 117.7, 117.9, 50.1, 50.2, 36/136
See application file for complete search history.

(56) References Cited

U.S. PATENT DOCUMENTS 1,752,254 A * 3/1930 Gosnell ..... 36/8.4
4,064,642 A * 12/1977 Vykukal et al. ..... 36/92
4,253,251 A * 3/1981 Salomon ..... 36/117.9
4,562,654 A 1/1986 Hue
4,638,578 A * 1/1987 Eiteljorg, II ..... 36/117.9
4,670,999 A * 6/1987 Olivieri ..... 36/118.1
4,823,485 A * 4/1989 Kemmer ..... 36/117.9
4,922,634 A * 5/1990 Seidel ..... 36/117.8
4,937,951 A * 7/1990 Loecker ..... 36/117.8
5,154,011 A * 10/1992 Holzl et al. ..... 36/117.2
5,177,884 A 1/1993 Rullier
5,566,475 A * 10/1996 Donnadieu ..... 36/55
5,966,841 A * 10/1999 Barret ..... 36/50.1

(Continued)

FOREIGN PATENT DOCUMENTS

DE 33 36 442 4/1984

(Continued)

*Primary Examiner*—Marie Patterson
(74) *Attorney, Agent, or Firm*—Collard & Roe, P.C.

(57) ABSTRACT

The invention relates to a sports boot (1) for walking or cross-country skiing, with a flexible shaft (2) receiving the foot, and a reinforcement (5) surrounding the shaft (2) on its external side by sections and being connected with the outsole (3). The shaft (2) is formed in this connection by a cushioned inner boot (6), and a coat (8) of fabric o some other material compatible with the skin. The reinforcement (5) is formed by a latticed or net-like support structure (12) for the inner boot (6), and composed of flexible ribbon elements (13) having, however, the highest possible tensile strength, and being made of plastic or textiles, said ribbon elements resting against external part sections of the inner boot (6), or surrounding the inner boot (6) on its external side within part sections. In this connection, the latticed or net-like support structure (12) is variable with respect to its delimiting or receiving volume as required by means of a lacing system (14). In addition, a soft overstocking (16) is formed, which surrounds the latticed or net-like support structure (12) at least by sections, and serves there for sealing or shutting off the interior of the boot versus external environmental influences.

29 Claims, 5 Drawing Sheets

U.S. PATENT DOCUMENTS

| | | | | |
|---|---|---|---|---|
| 6,772,540 | B2 * | 8/2004 | Delgorgue et al. | 36/50.5 |
| 7,086,181 | B2 * | 8/2006 | Farys | 36/50.5 |
| 2002/0007570 | A1 | 1/2002 | Girard | |
| 2002/0083617 | A1 * | 7/2002 | Tsou et al. | 36/8.4 |
| 2003/0009907 | A1 * | 1/2003 | Schuver et al. | 36/8.4 |
| 2004/0025373 | A1 * | 2/2004 | Schuver et al. | 36/8.4 |
| 2004/0074110 | A1 | 4/2004 | Borsoi | |

FOREIGN PATENT DOCUMENTS

| | | | |
|---|---|---|---|
| DE | 40 32 826 | | 5/1991 |
| DE | 3 33 6442 | | 4/1994 |
| DE | 92 14 715.1 | | 4/1994 |
| EP | 0 416 437 | A1 | 3/1991 |
| EP | 0 521 287 | | 1/1993 |
| EP | 0 651 953 | | 5/1995 |
| EP | 0 750 860 | | 1/1997 |
| EP | 0 753 268 | | 1/1997 |
| EP | 1 144 909 | | 8/2004 |

* cited by examiner

SPORTS SHOE FOR RUNNING OR CROSS-COUNTRY SKIING

CROSS REFERENCE TO RELATED APPLICATIONS

Applicants claim priority under 35 U.S.C. §119 of Austrian Application No. A 185/2005 filed Feb. 4, 2005.

BACKGROUND OF THE INVENTION

1. Field of the Invention

The invention relates to a sports shoe for running or cross-country skiing, as it is specified in the introductory part of claim 1.

2. The Prior Art

EP 0 416 437 A1 describes a sports boot for walking or cross-country skiing, which has a flexible shaft for receiving the foot. Said shaft is connected with an outsole, which is provided with coupling elements for detachably connecting it with a touring ski binding as required. In this connection, the shaft for receiving and covering the foot is usually solidly glued to the outsole, which preferably consists of plastic. The shaft including the outsole connected thereto usually has a pliability or flexibility such that when skiing or walking with such a sports boot, a bending zone is formed between the toes and the metatarsal bone, which permits the foot to roll off via the balls of the toes. Said known flexible shaft has a reinforcement in the rear or heel section, which is joined with the outsole and with the shaft, in particular by gluing or sewing it thereto. A stiff collar or cuff is articulated on said rear reinforcement, which is intended for surrounding the lower part of the leg. In this connection, the rear reinforcement on the outer side of the shell, and the cuff articulated thereon, form a stabilizing device for the ankle joint between the foot and the leg. In its upper part section, the shaft of said sports boot may be provided with a covering, which is intended to cover the lacing of the sports boot in the closed condition. In this connection, the support of the front section of the foot is substantially determined by the shaft receiving the foot, or by its lacing system. In connection with said known sports boot, therefore, the support for the foot is substantially determined by the cut or shape of the shaft, and by the elastic width or resiliency of the boot-lacing device.

DE 33 36 442 A1 describes a cross-country skiing boot with a double shaft and a double closing system. Said touring boot has an inner part shaft that surrounds only a part of the forefoot. Said inner part shaft is open at its top side and can be constricted with the help of a lace or some other tightening system. The inner part shaft is provided is provided so as to ensure that the forefoot is held in the interior of the outer shaft in conjunction with the outsole. The outer shaft covers the entire foot of the user, and is secured on the sole jointly with the inner part shaft. Thus the outer shaft surrounds the entire foot of the skier, starting from the heel below the angle-bone up to the tips of the toes. Within the area of the instep or metatarsal bone, said outer shaft has a step-in or step-out opening, which can be narrowed or widened as required with the help of a further closing system. It has been possible with such a double shaft to enhance the support of the forefoot; however, the wearing comfort of such a sports boot is inadequate or hardly satisfying for some users.

SUMMARY OF THE INVENTION

The present invention is based on the problem of providing a sports boot for exercising running sports, in particular the cross-country skiing sports discipline, that permits enhanced adaptability to a great number of shapes of feet, and offers safe support for the foot without excessively impairing the wearing comfort.

Said problem of the present invention is resolved by a sports boot according to the features specified in the characterizing clause of claim 1. One advantage of such an embodiment lies in that the sports boot as defined by the invention permits perfect adaptation to differently shaped feet, and offers good support for the foot. In particular, the specified sports boot permits efficient transmission of force between the foot of the user and the underground, or an item of sports equipment, particularly vis-à-vis a touring ski. The good fit or adaptability of the sports boot to differently shaped feet, such fit being free of play to the greatest possible extent, is a basic precondition in this connection as well for being able to increase the efficiency of a user or skier. In this connection, the good support of the foot in said sports boot does not impair the wearing comfort in such a sports boot, but permits achieving particularly high comfort while the sport is being exercised. In particular, optimal roll-off via the ball of the heel is made possible, or a physiologically favorable walking or running gait can be carried out during walking or running. On the one hand, this is achieved by virtue of the fact that the latticed or net-like holding structure is predominantly responsible for positioning or holding the inner boot versus the outsole, and that said latticed or net-like holding structure can be well-adapted to the inner boot or the foot received therein, without transmitting unpleasant pressure points to the foot of the user. Furthermore, the flexibility of the specified sports boot is primarily determined by the mechanical properties of the outsole. In particular, the latticed or net-like holding structure and the inner boot on the outsole hardly impair the flexing of the shell or the so-called upper footwear of the sports boot. In this connection, mainly the inner boot of the sports boot is responsible for high comfort and good fit, or embedding of the foot in soft cushioning. Thus the inner boot can be optimally adapted in a simple manner to the given anatomical conditions or different shapes of feet such as, for example a high instep, a low instep, a long forefoot, a short forefoot, and the like. For example, an ideal adaptation to the deviations in shapes of female and male feet is possible in a simple way by using different inner boots. It is especially advantageous, furthermore, that the overstocking can be provided with special softness and flexibility, which permits stepping into and out of the sports boot in a comfortable way. In particular, such a soft outer skin or flexible coat can be easily stretched downwards or rolled down in order to remove the inner boot from or insert it in the lattice- or net-like holding structure as needed. Furthermore, the particularly flexibly designed overstocking can be pulled up or stretched again by the user without problems in order to restore it to its proper or intended condition of use. Moreover, such a highly flexible overstocking, which has the flexibility of a fabric at least in the area of the collar or cuff of the sports boot, is particularly effective with respect to sealing off the inner components or interior elements of the sports boot. Furthermore, the soft overstocking offers increased comfort in using the sports boot, and ensures good sealing versus external environmental influences such as, for example snow, moisture, dirt and the like, which are difficult to keep away. In addition, an overstocking pulled over the inner boot and over the latticed or net-like support structure can counteract undesirable adhesion or accumulation of foreign matter such as, for example snow, ice or dirt when the sports boot is in its condition of use.

An embodiment according to claim 2 is advantageous in this connection in that it allows the inner boot to be effortlessly inserted in the latticed or net-like support structure, and simply removed from the latticed or net-like holding structure as needed, or from the fabric-like, flexible overstocking, for example for drying purposes or for activities in indoor areas.

The embodiment according to claim 3 is advantageous in that the flexibility of the sports boot is mainly determined by the stiffness of the outsole, because the shaft or upper footwear has only minor influence on the flexibility of the sports boot, and, furthermore, because any formation of folds, or occurrence of shearing forces and entanglements or distortions caused thereby in sections of the top footwear, are simply and effectively avoided or reduced.

An embodiment according to claim 4 is particularly beneficial as well in that the latticed or net-like support structure can be opened relatively widely, or its receiving volume highly enlarged as required, so that the inner boot can be inserted in or removed from the support structure in a particularly comfortable and effortless manner. In addition, a type of "variable cage" is obtained in this way, by which the forefoot section of the inner boot is supported in relation to the outsole in an exactly positioned and stable way. Furthermore, owing to the functional or structural separation of the upper instep or foot pressure plate and the lateral limitations, the respective anchoring elements and the instep or foot pressure plate can be adapted in the best possible way to the functions to be performed by such elements, or optimized in that respect.

The design according to claim 5 is advantageous in that starting from a relatively wide or loosened "ready" position, the latticed or net-like support structure can be changed with the lacing system to a relatively narrow holding position for the inner boot by tightening or activating the lacing system. In the tightened or active condition of the lacing system, safe securing or holding of the inner boot vis-à-vis the sole of the boot, or versus the pliant, yet highly tension-proof, cage-like or latticed support structure, is then assured.

The embodiment according to claim 6 permits exerting high tensile or tensioning forces on the inner boot when the lace system is tied by the user, on the one hand, and a relatively wide variation range is created with respect to the receiving or delimiting volume of the latticed or net-like holding structure, on the other hand.

A further development according to claim 7 is beneficial as well in that friction losses can be kept as low as possible in this way when the lacing system is tied or tightened, and the tensioning forces can be distributed as evenly as possible with low tensile forces expended on part of the user. Moreover, the instep or foot pressure plate, which is supported on the inner boot in a quasi-floating manner, can be positioned by the user on the forefoot as centrally as possible, and subsequently pulled tight, so that an optimal support or an ideal pressure distribution is achieved above the forefoot or on top of the metatarsal bone, because after the instep or foot pressure plate has been positioned and is then held via the lacing system, the instep or foot pressure plate can be displaced transversely relative to the longitudinal axis of the boot, so that a favorable alignment of said plate versus the inner boot, or vis-à-vis the foot is obtained in this way in a simple manner.

The embodiment according to claim 8 is also advantageous in that the lacing is provided in at least one of the side areas of the forefoot and not extending on the central top side, i.e. above the metatarsal bone. Pressure points conditioned by the lacing, or caused by the force introduction points of the latter, are avoided in this way in the best possible manner. Therefore, the lacing quasi extending in a vertical or inclined plane in one of the side areas, or preferably in both lateral areas of the forefoot, substantially contributes to raising the comfort. Furthermore, owing to the lateral arrangement of the lacing system, the lacing is prevented from causing pinching of the forefoot or above the metatarsal bone, or from getting distorted there when relative movements occur between the foot and the sports boot. In addition, the bending or flexibility behavior of the sports boot can be improved owing to the lateral or out-of-center arrangement of the lacing system for the latticed or net-like holding structure.

The embodiment according to claim 9 is beneficial as well in that a cover-like extension over the forefoot is provided due to such pre-contouring or predefining of the instep or foot pressure plate, which distributes the occurring forces in the best possible way and at the same time causes as few problem zones for pressure points as possible. Extending the instep or foot pressure plate transversely to the longitudinal axis of the boot across the range of the instep furthermore permits mounting of the lacing system, or of reversing elements for the lacing system in lateral zones of the foot or forefoot that are relatively insensitive to pressure points.

Owing also to the embodiment according to claim 10, it is possible to avoid pressure points or chafing points on the forefoot during walking movements, or caused by displacements in the flexing zones of the foot.

Advantageous is also an embodiment according to claim 11 because it permits providing an instep or foot pressure plate that has adequate tensile strength and good adaptability to the top side of the inner boot or form of the forefoot. In addition, it permits to keep the weight of the instep or foot pressure plate low, which may increase the efficiency the user can attain with the sports boot.

It is beneficial in connection with the embodiment according to claim 12 that defined zones of buckling or deformation are created that permit good adaptation of the instep or foot pressure plate to the top side of the foot or inner boot. Especially if such weakened zones are formed in the form of a film hinge, it is possible to exactly predefine the alignment or position of the deformation zones or bending radii in the instep or foot pressure plate.

It is advantageous in connection with the embodiment according to claim 13 that the inner boot can be effortlessly inserted in the latticed or net-like support structure, or placed in a simple manner on the upper support surface of the outsole without any interference caused by the anchoring elements, or without such anchoring elements substantially interfering with the assembled structure of the sports boot.

The measures according to claim 14 are advantageous in that the anchoring elements form a lateral support for the inner boot, so that said elements are capable of preventing the inner boot from slipping off laterally versus the outsole. Moreover, the height of the anchoring elements is selected in such a way that the lacing system may extend in the lateral zones of the foot or forefoot, so that pressure points are prevented from occurring on the central metatarsal bone, or on the upper side of the forefoot, to begin with.

By virtue of the embodiment according to claim 15, it is possible to align in a purposeful manner the directions of tension or the tensile forces acting on the instep or foot pressure plate, so that the force or the pressure of said element is exerted on the forefoot in the best possible way, and safe fixation of the inner boot or foot vis-à-vis the outsole is assured. In addition, it is possible in this way to avoid friction losses or jamming of the pulling element within the tying or lacing section of the support structure.

It is advantageous in connection with the embodiment according to claim 16 that the anchoring elements do not or only slightly influence or impair the bending behavior of the sports boot or the flexibility of the outsole, because the primary flexing zone occurs in the section with the roots of the toes, or toe joints, thus in the front boot tip area, and the outsole will not be blocked or stiffened in said flexing zone. Moreover, the anchoring elements provided on both sides assure that the outsole is lifted from and pressed against the bottom side of the inner boot with as little clearance as possible.

The manufacture of the latticed or net-like support structure at favorable cost is assured by the measures according to claim 17. In addition, said embodiment offers optimal adaptation of the support structure to the surface of the inner boot or form of the foot, so that it is assured that the foot is fixed in the sports boot with as little play as possible, but nonetheless free of pressure points.

It is advantageously accomplished with the measures according to claim 18 that the heel section of the sports boot is pressed against the heel with adequate firmness as well, which ensures that the heel of the user in the sports boot is forced with sufficient firmness against the outsole, or against the rearward part of the sports boot.

Owing to the further development according to claim 19, it is avoided in a simple manner that the foot or the inner boot slides off rearwards versus the outsole when push-off movements are performed with the sports boot, or when walking with the sports boot steeply uphill.

Owing to the further development according to claim 20, the inner boot, or the foot inserted in the inner boot can be forced or pressed forwards with respect to the longitudinal axis of the boot without exerting excessive or unpleasant pressure stress on the heel. This permits the inner boot or the foot to be fixed vis-à-vis the outsole with particular freedom of play.

It is advantageous in connection with the further development according to claim 21 that in the unstressed or idle condition, the heel pressure plate assumes a predefined position that facilitates placing the inner boot on the support surface on the outsole. Furthermore, this permits the rear end section of the outsole to be pressed with adequate firmness against the bottom side of the inner boot.

It is beneficial in conjunction with the embodiment according to claim 22 that when the anchoring elements on the heel side are subjected to tension or tensile stress, the heel pressure plate is simultaneously forced forwards or forced against the heel of the user. In this way, when the lacing system is tightened, not only the forefoot is fixed, but the heel section is fixed and supported at the same time vis-à-vis the outsole as well.

The direction in which the force of the heel pressure plate is acting, can be changed owing to the advantageous further development according to claim 23, on the one hand, and the amount of acting force can be influenced, on the other hand, because the points of force introduction can be displaced, which changes the resulting effects of the force according to the lever principles, on the other hand.

The direction of the force and the amount of the force exerted by the heel pressure plate can be changed and fixed in a simple way owing to the measures according to claim 24. In particular, any adjustments made can be changed in this way without tools, and individual adaptation to the given preferences or requirements is made possible. Moreover, any adjustments made are secured in a simple way against any automatic or undesirable readjustment.

Owing to the embodiment according to claim 25, pressure stresses in points within the heel area are avoided, and, furthermore, the heel section or rear end section of the inner boot is laterally supported or laterally held versus the outsole.

A positionally exact fixation of the tip area of the inner boot or tip of the foot is achieved through the further development according to claim 26. Moreover, said toe cap hardly or only marginally impairs or influences the flexing behavior of the outsole. In particular, the flexing zone of the toe joints or the flexing zone between the tarsal bone and the forefoot is not impaired by such a toe cap. The cap-like design of the tip areas of the outsole, furthermore, offers good support of the tip of the foot in the vertical direction relative to the outsole, and, furthermore, forwards in the direction of the longitudinal axis of the boot, as well as support of the foot or inner boot also in the transverse direction relative to the longitudinal direction of the boot.

It is advantageous in connection with the further development according to claim 27 that the instep or foot pressure plate, which is supported in a more or less floating manner, is supported positioned in the rearward direction. In particular, it is avoided that the instep or foot pressure plate is pulled upwards or into the flexing zone between the leg and the foot as the lacing system is being tightened. Furthermore, a starting position optimizing the step-in is provided by such a connecting element for the instep or foot pressure plate, by which the insertion of an inner boot in the latticed or net-like support structure is facilitated.

Unpleasant pressure points on the top side of the foot can be avoided or kept negligible in spite of the skeleton-like and thus weight-optimized structure of the instep or foot pressure plate.

The latticed or net-like support structure can be at least partly exposed in a particularly simple way, if need be, in order to assure good accessibility to the interior of the boot. In this connection, the top material of the thin overstocking can offer an ideal sealing function against adverse external influences. In combination therewith, the textile base material of the overstocking ensures that the contact with the skin is pleasant if the inner side of the overstocking comes into direct contact with the foot of the user. In addition, the textile base material can assure absorption of moisture or excreted perspiration. Furthermore, inhibition of slip between the overstocking and the inner boot, or between the overstocking and the latticed or net-like support structure is achieved on account of the textile base material.

Good sealing against moisture is assured, on the one hand, and, moreover, adequate tightness of the sports boot is secured also after intensive use, or use over a long time.

The absorptive power of the base material is maintained high through the measures. Moreover, high flexibility and tight foldability, or intensive gathering of the overstocking is preserved in spite of the two-layered structure of the overstocking.

Another embodiment is advantageous as well in that the overstocking reaches up to the top edge of the outsole, and thus substantially contributes to increased tightness of the walking or touring ski boot.

The further development is also beneficial in that proper seating of the inner boot in the latticed or net-like support structure can be controlled from the outside in a simple manner. Furthermore, with an adequate size and suitable positioning of the sight window, correct extending or appropriate tightening of the lacing system can be checked by the user in a simple way as well. Irrespectively thereof, an attractive overall visual appearance of the sports boot is obtained as a result.

It is made possible to view without problems the construction of the sports boot. In addition, the desired flexibility of the overstocking in the upper end section or within the area of the cuff of the boot, and in the area of the instep is not or only hardly impaired or reduced thereby, since the higher rigidity of the transparent or translucent plastic has the least negative influence in the areas of the anchoring elements.

The features ensure that the sports boot is particularly comfortable, as the foot is received in an ideally cushioned or lined inner boot, which can be subsequently inserted in the latticed or net-like support structure. In addition, such an inner boot is suited for use in indoor areas as a so-called indoor boot, or as a warm slipper. In this way, following its use for exercising sports, the outer boot can be left, for example in the basement, and actual living quarters can be entered in a comfortable manner with the inner boot. In addition, the expandability of the inner boot, or the materials used for the latter permit with only one type of inner boot a satisfying adaptation to a plurality of different forms of feet.

BRIEF DESCRIPTION OF THE DRAWINGS

The invention is explained in detail in the following with the help of the exemplified embodiments shown in the drawings, in which.

DETAILED DESCRIPTION OF PREFERRED EMBODIMENTS

It is noted by way of introduction that identical components of the different embodiments described are provided with identical reference numbers or identical component designations, whereby the disclosures contained throughout the entire description can be applied in the same sense to identical components denoted by the same reference numbers. Furthermore, positional data selected in the specification such as, for example "top", "bottom", "lateral", etc., relate to the figure directly described and shown, and have to be applied to the new position where a position has changed. Furthermore, also individual features or combinations of features of the different exemplified embodiments shown and described may per se represent independent inventive solutions, or solutions as defined by the invention.

Figure 1:
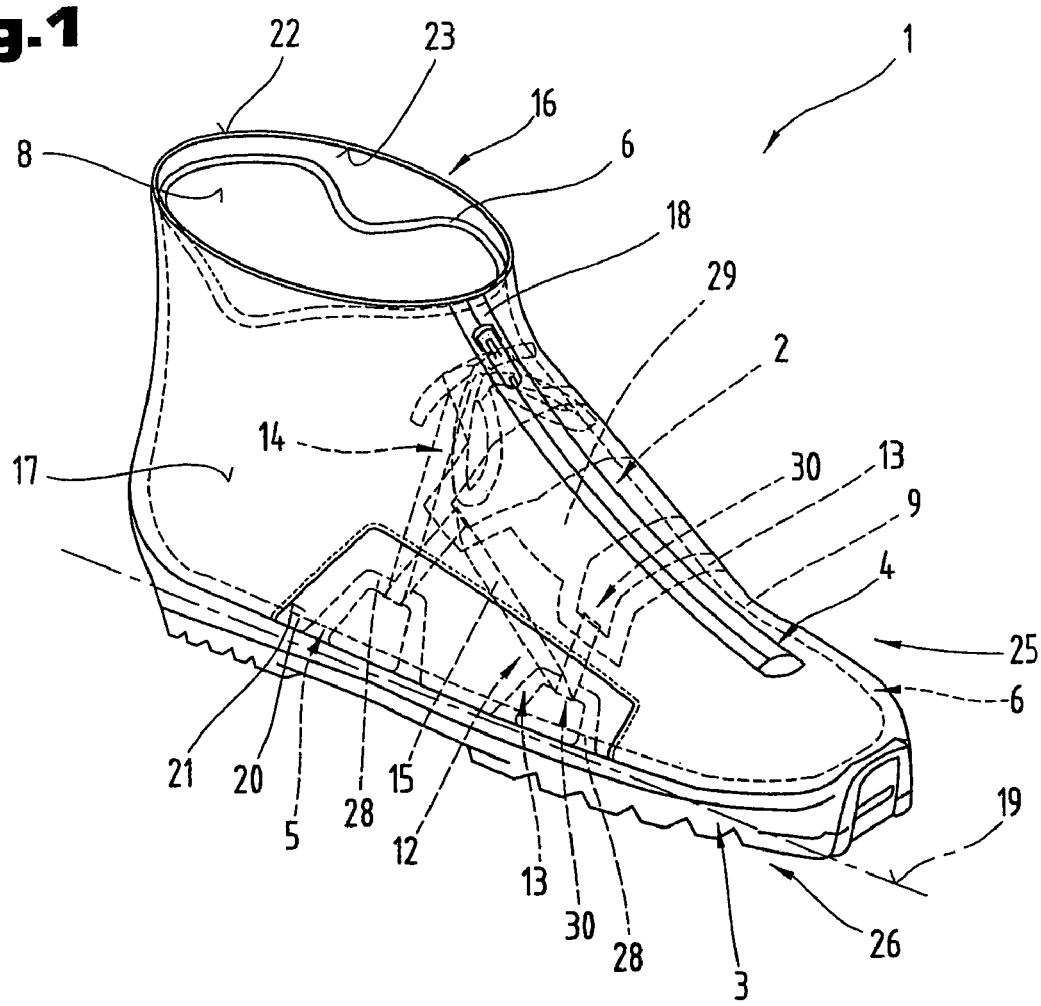
FIG. 1 shows by way of example a schematic representation of a sports boot for walking or cross-country skiing, comprising an inner boot, a latticed or net-like support structure for the inner boot, a lacing system, an overstocking for said components, and an outsole.
Figure 2:
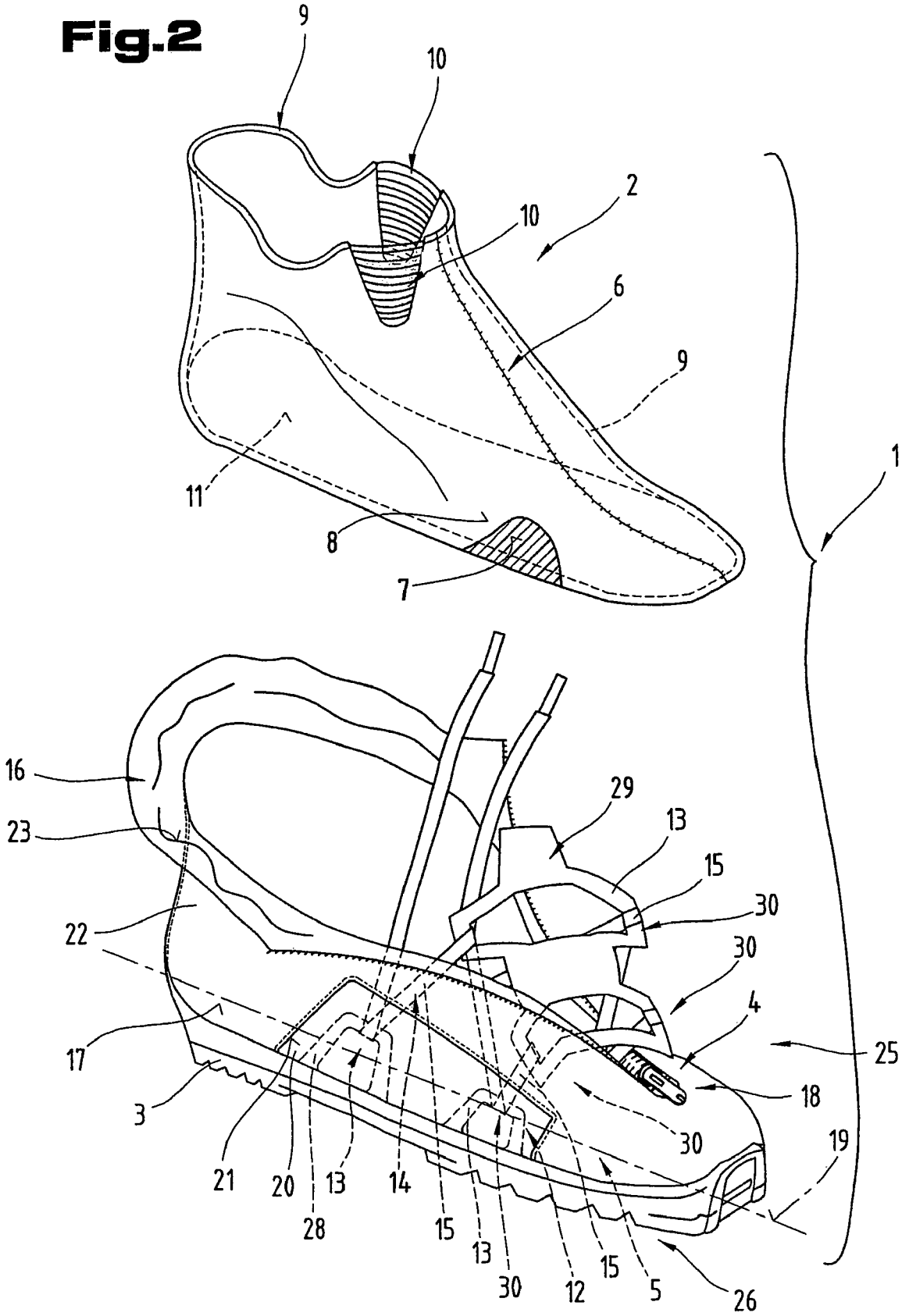
FIG. 2 is a simplified schematic representation of the sport boot according to FIG. 1, with the inner boot removed and the overstocking folded downwards, as well as with the opened and widened support structure for the inner boot.

FIGS. 1 and 2 show by way of example a schematic representation of a sports boot 1 according to the type concerned herein. Such a sports boot 1 is preferably designed as a touring ski boot. The structure of the boot described in the following may, of course, be used for other sports shoes such as, for example running shoes, hiking or trekking boots, touring shoes, or for similar sports shoes as well. The structure described in the following is particularly suited for sports shoes, in connection with which a gait that is as natural as possible is advantageous, or for sports disciplines, in conjunction with which good support of the foot in the sports shoe and efficient transmission of force to the ground, in particular to an item of sports equipment that is connectable with the sports boot 1, such as, e.g. a touring ski, are required.

The sports boot 1 has a flexible shaft 2 capable of flexing during walking or running movements, which surrounds the forefoot including the toes, extends rearwards up to the heel, and surrounds also the back side of the foot. In this connection, the shaft 2 may end below the ankle bones, and designed as a so-called low shaft, or also as a high shaft, reaching in that case up to slightly above the ankle bones, as it is advantageous mainly when exercising the skating sport in connection with touring skis. The shaft 2, which thus substantially surrounds the entire foot and can be referred to also as top foot wear, is provided on the bottom side with a suitable outsole 3, as it is known per se.

The shaft 2, or the "foot shell" that can be equated with such a shaft 2, is flexible in spite of the connection with the outsole 3 at least to an extent such that it permits walking or running in a way that is as natural as possible. In particular, with the specified sports boot 1 with the flexible shell 2 and the outsole 3, it is possible to assure a roll-off movement via the balls of the toe, or a flexing zone 4 that is disposed between the ball of the foot, or the metatarsal bone and the toes.

Mainly if the sports boot 1 is designed as a so-called cross-country boot, at least one coupling element, for example a protrusion or a transversely extending pin is provided on the outsole 3, such pin permitting an, if necessary detachable connection with a binding system on a board-like sports article, particularly of the type of a touring ski.

The shaft 2, which predominantly consists of soft or yielding materials and ensures the wearing comfort, is provided at least by sections with a reinforcement 5, which ensures that the occurring forces are reliably absorbed, or the reinforcement 5 assures that the forces are transmitted effectively and aligned on target. In this connection, the reinforcement 5 is joined with the outsole 3 in order to safely absorb the occurring forces, or transmit the latter between the outsole 3 and the shaft 2.

The flexible shaft 2 for receiving the foot thus mainly assumes the function of comfort, whereas the reinforcement 5 for the flexible shaft 2 serves for connecting it in a fixed manner with the outsole 3.

It is important that with the specified sports boot 1, the shaft 2 is formed by a separate or structurally independent inner boot 6. In this connection, the inner boot 6 for the sports boot 1 is formed relatively soft or yielding. In particular, the inner boot 6 is predominantly cushioned. Above all, the sections of the inner boot 6 surrounding the upper part of the forefoot, and the lateral sections of the foot, as well as the areas around the ankles of the foot are lined or cushioned in this connection.

A cushioned or soft inner boot 6 has to be understood to represent substantially sock-like boots made of a foam plastic 7 in conjunction with a textile fabric or cover 8 consisting of synthetic or natural fibers or threads. The thickness of the inner boot 6, or its cushioning 9 usually amounts to at least 3 mm in the thinnest part sections, and may amount up to 20 mm in the thicker part sections. The cushioning 9 of the foam plastic 7 is preferably provided with a cover 8 of textile fibers, which may be woven or nonwoven, and covers the cushioning 9 or the foam plastic 7 at least by sections. The cover 8 or textile fabric on the outer and/or inner sides of the inner boot 6 assures at least increased tear resistance, and resistance to wear and/or a pleasant contact of the skin with the inner side of the inner boot 6. The cushioning 9 made of the foam plastic 7 is primarily intended for avoiding pressure points. The cushioning 9 and its cover 8 are elastic to a certain extent in order to allow the foot to slip into the preformed inner boot 6.

If necessary, the inner boot 6 may be provided with at least one elastic collar 10 in order to make it easier to slip into and out of the inner boot 6, while nonetheless assuring a good fit of the inner boot 6 via-a-vis the foot. The inner boot 6 is a type of sock with respect to its fit, which permits the inner boot 6 to fit the foot of the user in a relatively snug way. The relatively thick cushioning 9 of the inner boot 6 effects thermal insulation of the foot versus the external environment of the inner boot 6 as well.

The inner boot 6, which is shaped or foamed in accordance with the anatomical conditions, and coated with the fabric-like cover 8, may have an insole or outsole 11, permitting the inner boot 6 to be used as a slipper, or as an abrasion-resistant and nonslip foot coating for indoor use. In particular, any forms and designs of inner shoes 6 that are known from the prior art, and offer an adequate cushioning 9 and sufficient wearing comfort, are possible.

It is important, furthermore, that the reinforcement 5 of the sports boot 1 is formed by a latticed or net-like support structure 12 for the inner boot 6. The shaft reinforcement formed by a latticed or net-like support structure 12 consists of the flexible ribbon elements 13 made of extruded plastic or suitable textiles, exhibiting, however, tensile strength to the highest possible degree. "Flexible" has to be understood to mean that the ribbon elements 13 of the latticed or net-like support structure 12 can be deformed or bent by hand or fingers. "Tensile strength to the highest possible degree" is to be understood to mean that the ribbon elements 13 for the latticed or net-like support structure 13 will substantially maintain their length with no change in the presence of the occurring tensioning or tensile forces, and that no visually recognizable changes in length will be caused under the stresses normally occurring.

Said flexible ribbon elements 13 exhibiting, however, tensile strength to the highest possible extent, are arranged in a way such they rest against sections of the outer side or external surface of the inner boot 6, or surround the inner boot 6 on its external side at least within part sections. In this connection, at least some of the ribbon elements 13 of the latticed or net-like support structure 12 are connected with the outsole 3, and thus represent the shell reinforcement or reinforcement 5 for the shaft 2 formed by the inner boot 3. The latticed or net-like support structure 12 ensures that the inner boot 2 can be joined in a fixed way with the outsole 3, but that the inner boot 2 is nonetheless removable from the outsole 3, or versus the support structure 12, if need be, as this is evident from FIG. 2. The latticed or net-like support structure 12 on the top side of the outsole 3 thus forms a type of "cage" or holding frame for the cushioned inner boot 2 via-a-vis the outsole 3.

The latticed or net-like support structure 12 secured on the outsole 3 can be changed as required with respect to its delimiting or receiving volume by means of a lacing system 14, i.e. that via the lacing system 14, the space enclosed by the latticed or net-like support structure 12 can be narrowed down or expanded as needed. The lacing system 14 may comprise any type of desired ribbon-, cord- or string-like pulling element 15 known from the prior art, which further transmits the tensioning or tensile forces exerted by the user to the interior of the sports boot 1, particularly to the latticed or net-like support structure 12. In particular, by means of the lacing system 14, the inner boot 6 and thus the foot is fixable in the sports boot 1 or within the latticed or net-like support structure 12, and thus versus the outsole 3. When the lacing system 14 or the pulling element 15 is loosened, either the foot together with the inner boot 6 can be jointly removed versus the support structure 12, or only the foot without the inner boot 6 can be pulled out of the sports boot 1, whereas the inner boot 6 remains within the latticed or net-like support structure 12. Preferably, however, the foot and the inner boot 6 are jointly removed from the effortlessly expandable latticed or net-like support structure 12 if the user intends to pull off the sports boot. The elastic inner boot 6 relatively closely fitting the foot as a type of thick sock, is then pulled off as the last item.

It is important, furthermore, that a soft or inherently yielding overstocking 16 with hardly any dimensional stability is formed, which quasi represents the external encasement of the sports boot 1. In particular, said overstocking 16 encloses the latticed or net-like support structure 12 at least by sections, and in such sections, said overstocking 16 forms a seal or bulkhead-like separation for the interior space of the boot or latticed or net-like support structure 12 versus external environmental influences. In the closed or highly stretched and tensioned condition of the sports boot 1, or in the condition it is ready for use, the overstocking 16 forms a relatively smooth or plane-faced surface 17 of the sports boot 1, as it is evident from FIG. 1. In particular, the overstocking 16 covers the contours of the latticed or net-like support structure 12, and in this way prevents excessive adhesion of snow, ice or other foreign matter. The smooth surface 17 provided by the overstocking 16 may permit an attractive visual appearance of the sports boot as well. Furthermore, the overstocking 16 may contribute to a pleasant boot climate, and protect the interior of the boot against wetness or moisture and cold. In addition, the smooth surface 17 of the overstocking 16 may be dirt-repellent, or repellent versus snow, ice or water.

On top of the latticed or net-like support structure 12, the overstocking 16, which is relatively thin-walled as compared to said support structure, may have a thickness or material thickness of a few tenths of a millimeter, up to about 3 millimeters (mm). The overstocking 16 preferably being of the type of textiles tight to wind, is particularly flexible and yielding in any case, and in the opened condition thus can be relatively effortlessly folded in the direction of the outsole 3, or gathered together downwards, as it is evident from FIG. 2.

The overstocking 16 is preferably tight to liquid at least for a short time, and is therefore sewn and glued in as few sites as possible. The overstocking 16 is assembled from as few individual components as possible, and is designed as one single piece in the ideal case. The overstocking 16 is joined with the lateral edge sections of the outsole 3 as tight to liquid as possible, in particular by gluing or sewing, and extends upwards up to the opening for slipping into the boot 1. The overstocking 16 may be connected by sections with he latticed or net-like support structure 12; however, the predominating inside surface of the overstocking 16 is loose or freely disposed vis-à-vis the latticed or net-like support structure 12. The overstocking 16 forms the substantial proportion of the external surface 17 of the sports boot 1, or of the surface of the top footwear, as it is clearly evident from FIG. 1.

The thin and yet adequately tear-proof overstocking 16 thus has as few sewn or interrupted sites as possible. Preferably in the section covering the instep, the overstocking 16 has at least one closing means 18. In this connection, said closing means 18 may be formed by a zipper, and/or by a so-called Velcro® closure. Such a closing means 18 may be aligned parallel to the longitudinal axis 19 of the boot, or it may be positioned extending slanted or asymmetrically.

On its surface 17, the overstocking 16 may be provided with design elements and graphical imprints, or lettering not shown. If need be, a sight window 20 made of transparent or translucent plastic may be formed within the overstocking 16. Such a sight window 20 is inserted in a cutout 21 of the overstocking 16, and particularly sewn and/or glued together with the edges of the cutout 21. The optional sight window 20 consisting of transparent or translucent plastic offers insight at least to part sections of the latticed or net-like support structure 12 and to the interior boot 6. Thus the correct or intended assembly of the sports boot 1, or the correct seating of the components can be controlled by the user from the outside, and, in addition, the result is an interesting visual effect that is advantageous in terms of design.

The overstocking 16, with the sight window 20 inserted therein, if need be, is in any case realized in such a way that with the active closing element 18, any penetration of snow, ice or dirt into the interior of the boot, or any direct action of snow, ice or dirt on the inner boot 6 with the textile surface is avoided in the best possible way when the sports boot 1 is used in accordance with its intended application.

It is advantageous if the overstocking 16 is formed by a liquid-tight or liquid-repelling, highly flexible and thin-walled top material 22, and a textile base material 23, as it has been indicated in FIG. 1. In this connection, the overstocking 16 consists of a so-called functional textile material with a membrane function. In particular, the highly flexible overstocking 16, which can be gathered together downwards or in the direction of the outsole (see FIG. 2), assures that liquid or liquid droplets are repelled on its surface, whereas liquid vapors, starting from the interior of the boot, are either absorbed by the base material 23, or can be passed to the external side of the boot due to the membrane function, so that a foot climate as pleasant and healthy as possible is ensured. For increasing the repelling of liquid, or for augmenting the hydrophobic properties, or for reducing the adhesion of snow, it is beneficial if the overstocking 16 is coated with a plastic, whereby such a plastic coating is required to have elastomeric properties for maintaining the flexibility of the overstocking 16.

The base material 23 of the overstocking 16, which has absorptive power, if need be, has fibers that are capable of absorbing liquids, and are processed to a latticed or finely perforated fabric in order to achieve high absorptive power. The top material 22 and the base material 23 are preferably joined with one another or sewn to each other only by sections particularly in their marginal zones. The highly flexible embodiment of the overstocking 16 in maintained in this way in a simple manner in spite of its multi-layered design.

It is useful, furthermore, if the latticed or net-like support structure 12, which is covered by the overstocking 16 over its major part, but preferably completely, is comprised of at least two parts. The two-component or multi-component embodiment of the latticed or net-like support structure 12 is useful so as to be able to widen the support structure 12 at least transversely to the longitudinal axis 19 of the boot, or to be able to increase its delimiting or receiving volume, when required. In this way, it is assured that the structurally independently designed inner boot 6 can be easily disengaged from the latticed or net-like support structure 12 when necessary, and then removed from the latter. Likewise, effortless insertion of the inner boot 6, which is preferably designed as a walking boot or slipper, in the latticed or net-like support structure 12 is made possible in this way in a simple manner.

Furthermore, it is favorable if the inner boot 6, which is preferably suited for walking, is supported with limited relative mobility versus its upper support surface 24 on the outsole 3 (see FIG. 3), and vis-à-vis the ribbon elements 13 of the support structure 12. For this purpose, the inner boot 6 is not glued or sewn in any site to the support surface 24, and not in any site to the latticed or net-like support structure 12, but loosely inserted therein. In particular, the latticed or net-like support structure 12 represents a positively acting holding means or positioning device for the inner boot 6. Since minimal relative displacements between the support structure 12 or its ribbon elements 13 and the external surface of the inner boot 6, are permitted at least by sections and at least marginally when bending stresses are acting on the sports boot 1, its flexibility and wearing comfort are raised in an advantageous manner. In particular, owing to such defined relative displacements during walking movements with the sports boot 1, it is possible to perform a pressure point-free, relatively natural gait or roll-off process. As opposed thereto, any rigid connection, particularly a seam or a glued joint between the inner boot 6 and the support structure 12 would impair the flexibility or bending behavior of the sports boot, and a sports boot 1 designed in such a way would be comparatively stiffer.

FIGS. 3 to 6 show an enlarged representation of a possible embodiment of the latticed or net-like support structure 12, or of the components joined with the latter. The following descriptions of said figures have to be read in many respects in combination with the representations according to FIGS. 1 and 2.

Figure 3:
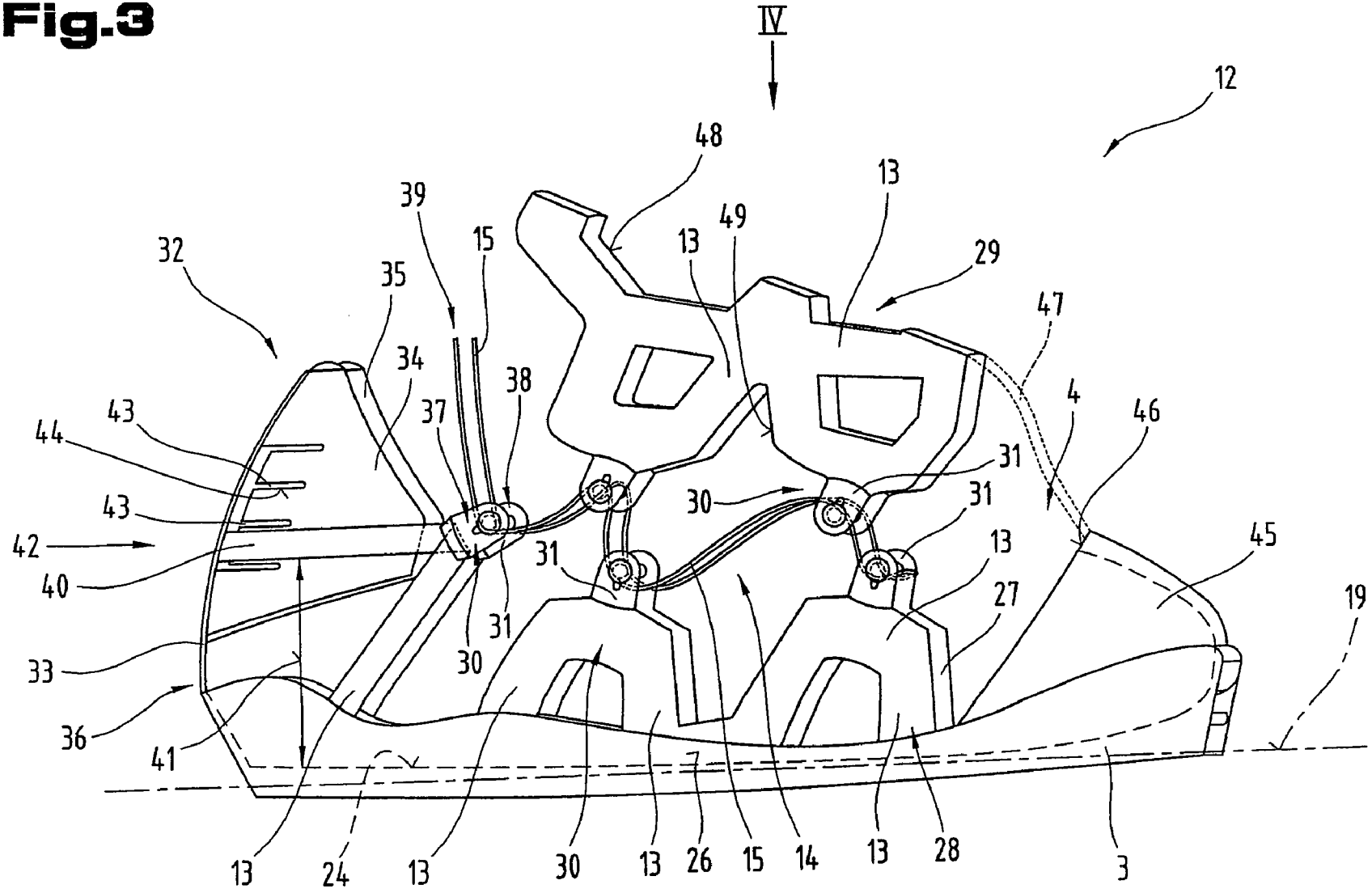
FIG. 3 is a simplified schematic side view of another embodiment of a support structure for the inner boot of a sports boot for walking or cross-country skiing.
Figure 4:
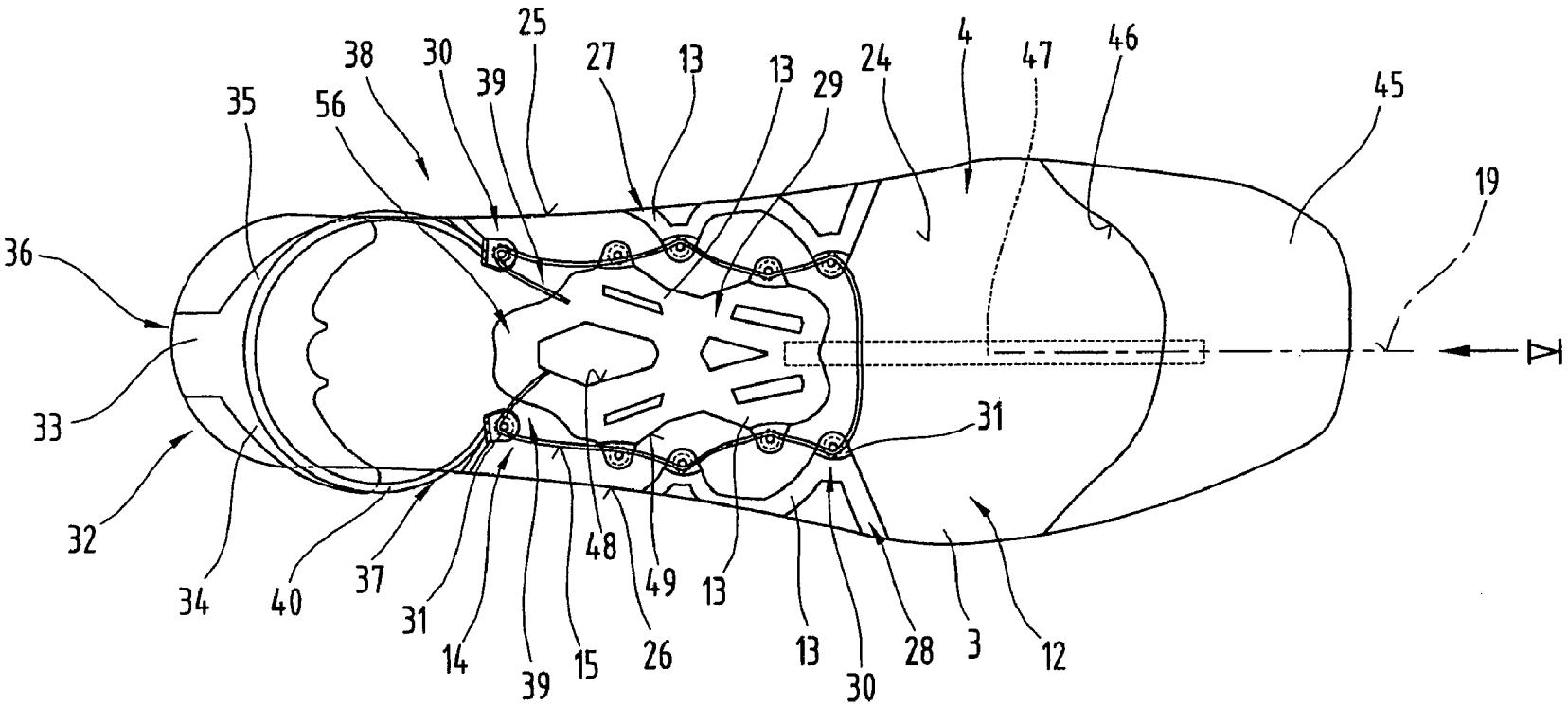
FIG. 4 shows the latticed or net-like support structure according to FIG. 3 viewed from the top or perpendicularly to the support surface for the inner boot on the outsole.

As it is evident most clearly from FIGS. 3 and 4, it is useful if the latticed or net-like support structure 12 comprises at least one anchoring element 27, 28 for the lacing system 14 arranged on the external side 26 of the boot. Preferably, the latticed or net-like support structure 12 also comprises at least one instep or foot pressure plate 29, which at least approximately bridges the lateral anchoring elements 27, 28. In this connection, the instep or foot pressure plate 29 is connected with at least one of the lateral anchoring elements 27, 28 by means of the lacing system 14. However, the instep or foot pressure plate 29 is preferably connected with both anchoring elements 27, 28 in order to obtain an alignment of the instep or foot pressure plate 29 that is as centric or central as possible. Alternatively, it is also conceivable to connect a lateral edge of the instep or foot pressure plate 29 with one of the anchoring elements 27, 28 in a length-invariable manner, and to connect the opposite lateral edge of the instep or foot pressure plate 29 with the other anchoring element 27, 28 via the length- or width-variable lacing system 14.

Important is only that the lacing system 14 connects the anchoring elements 27, 28 and the instep or foot pressure plate 29 in a manner such that the receiving volume defined by said elements is reducible when the lacing system is pulled tight. What is achieved in this way is that an inner boot 6 inserted in the support structure 12 can be connected with adequate stability, or almost undisplaceably with the outsole 3. For a distance-variable connection between at least one of the lateral anchoring elements 27, 28, and the instep or foot pressure plate 29 resting on the top side of the inner boot 6, the lacing system 14 is arranged laterally of the instep or foot pressure plate 29 bridging the instep or back of the foot. Unpleasant pressure points on the upper, relatively sensitive back of the foot can be avoided or minimized in this way.

For obtaining a wide tensioning range, and for effortlessly applying the required tensioning forces, it is advantageous if the lacing system 14 connects the instep or foot pressure plate 29 with at least one of the anchoring elements 27, 28 via at least one string- or lace-like pulling element 15 in a zigzag or undulated form. The lateral anchoring elements 27, 28 are connected in a fixed way to the lateral edge sections of the outsole 3, for example glued or sewn thereto, or injection-molded jointly with the outsole 3, or screwed thereto. On the one hand, the lateral anchoring elements 27, 28 serve as anchoring elements with the highest possible tensile strength for the lacing system 14, or the instep or foot pressure plate 14. The anchoring elements 27, 28 are preferably formed by strip- or ribbon-shaped elements made of plastic or textiles in order to be flexible, on the one hand, and to withstand as unyieldingly as possible the tensile forces occurring, on the other. Viewed from the side according to FIG. 3, the anchoring elements 27, 28, or the ribbon elements 13 forming the anchoring elements 27, 28, are bracket- or V-, U- or M-shaped in this connection. It is advantageous if said anchoring elements 27, 28 are connected with the outsole 3 in at least two sites, and said end sections of the anchoring elements 27, 28 disposed on the side of the outsole, change into a relatively smaller number of force introduction points for the lacing system 14. In the shown exemplified embodiment according the FIG. 3, the lateral anchoring elements 27, 28 each represent so-called "three-point" or "four point" force distributors, for which the ribbon elements laterally viewed according to FIG. 3, form approximately V-, M- or W-shaped structures, which are connected with the outsole 3 in a comparatively high number of positions spaced from one another in the longitudinal direction, and with the lacing system 14 in a comparatively lesser number of positions spaced from one another in the direction of the longitudinal axis 19 of the boot.

At their ends facing away from the upper support surface 24 of the outsole 3, the anchoring elements 27, 28 form at least one reversing device 30 for the string- or lace-shaped pulling element 15 of the lacing system 14. In particular, the central part section representing the base of a U- or bracket-shaped anchoring element 27, 28, may represent a reversing device 30 for the pulling element 15. Likewise, a loop of an anchoring element 27, 28, which may be formed by a ribbon of a textile fabric, may represent a reversing device 30 for the pulling element 15 of the lacing system 14. It is advantageous if two anchoring elements 27, 28 are provided both on the inner side 25 and the outer side 26 of the boot, which are connected with the outsole 3 in the center third of the longitudinal expanse or overall length of the support surface 24 for the inner boot 6, as it is shown by way of example in FIG. 3.

However, the instep or foot pressure plate 29 has at least one reversing device 30 for the string- or lace-shaped pulling element 15 of the lacing system 14 as well. Said at least one reversing device 30 is arranged in at least one of the lateral edge sections of the inlet or foot pressure plate 29. Preferably, the reversing devices 30 for the pulling element 15 are used in pairs on the instep or foot pressure plate 29 as well. The reversing devices 30 on the lateral edge sections of the instep or foot pressure plate 29 may be formed by bridges or breakthroughs on the instep or foot pressure plate 29 itself, or by structurally independent reversing devices 30, as this is evident from FIG. 3. In particular, the independent lacing elements 31, for example eyes, hooks, or rollers or ball lacing elements, may be formed in the lateral edge sections of the instep or foot pressure plate 29, and/or on the ends of the anchoring elements 27, 28 facing away from the outsole 3, such elements facilitating the lacing process or permitting the application of high lacing forces. In particular, said friction-reducing lacing elements 31 reversing the pulling element 15 may be sewn or glued to the instep or foot pressure plate 29, or injection-molded jointly with the latter, or secured in some other manner. In this connection, the lacing elements 31 may be formed by any desired auxiliary lacing means known from the prior art.

Figure 5:
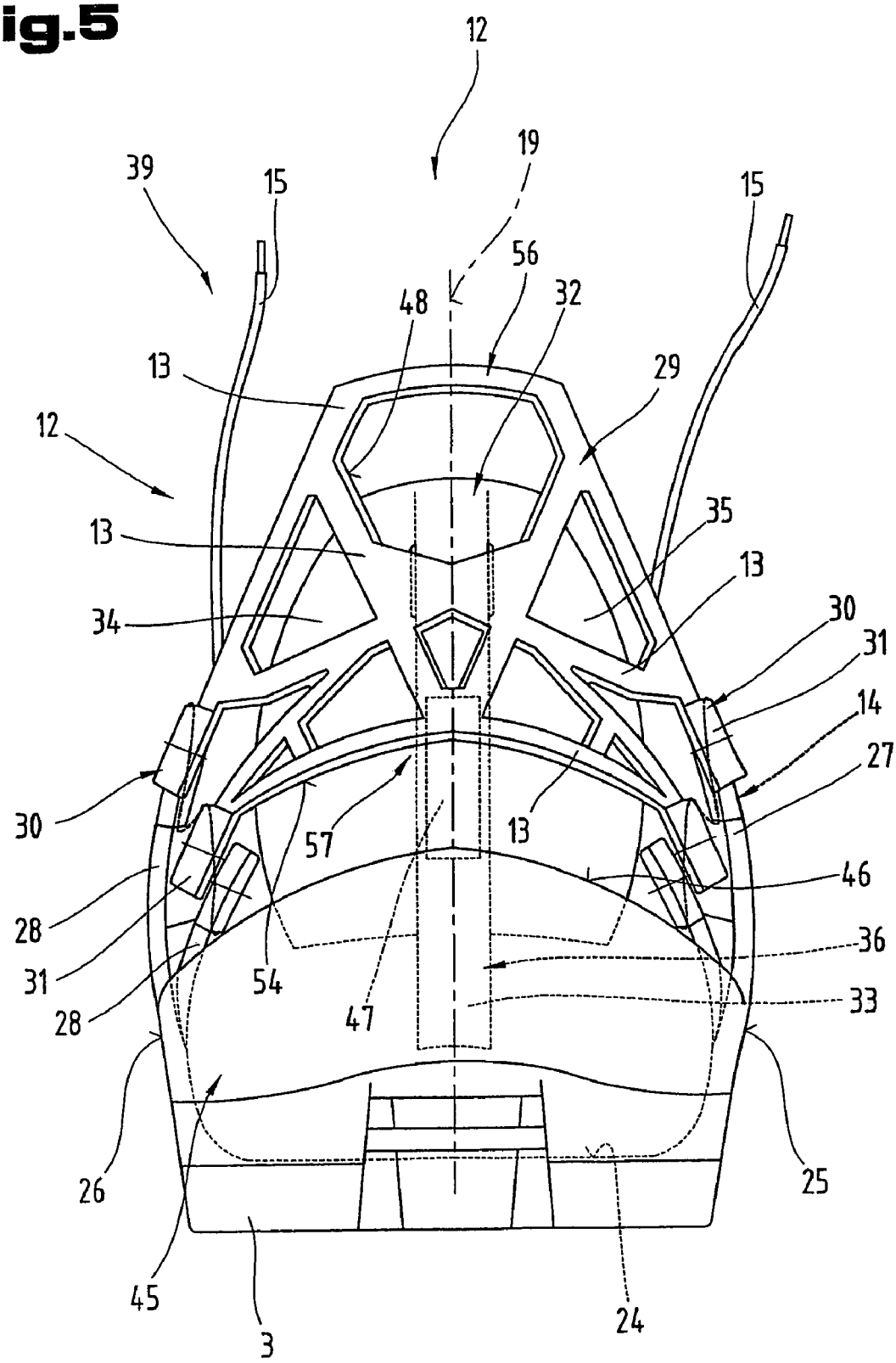
FIG. 5 shows the support structure including the outsole for the sports boot from the front, or viewed according to arrow V in FIG. 4.

It is useful if the lateral anchoring elements 27, 28 are provided with such rigidity that in the unstressed or starting or idle condition according to FIG. 1 or FIG. 5, they substantially project upwards or extend upright versus the outsole 3 perpendicularly to the support surface 24 for the inner boot 6. To achieve this, the anchoring elements 27, 28 are preferably formed by adequately rigid plastic elements produced by the plastics injection molding process. This ensures that the lateral anchoring elements 27, 28 and the outsole 3, or its support surface 4, jointly represent a receiving dish for the inner boot 6 that is open at the top, so that the latter can be easily or effortlessly inserted in the support structure 12. In particular, the installation of the inner boot 6 in the latticed or net-like support structure 12 is hindered only to a minor extent if the lateral anchoring elements 27, 28 exhibit adequate dimensional stability in order not to implode automatically, or not to fold or fall over. For example, anchoring elements 27 consisting of a narrow ribbon of fabric would be incapable of exhibiting such dimensional stability if they were not additionally supported in their dimensional stability by plastics or other measures.

It is useful if the lateral anchoring elements 27, 28 on the outsole 3 protrude by about 2 to 8 cm beyond the support surface 24. Said height of the anchoring elements 27, 28 relative to the support surface 24 may be dimensioned inclusively or exclusively of a reversing device 30 for the pulling element 15. Mainly if provision is made on the inner or outer side 25, 26, respectively, of the boot for a plurality of anchoring elements 27, 28 spaced from one another in the direction of the longitudinal axis 19 of the boot, it is advantageous if such anchoring elements are provided with different heights, whereby the height of the lateral anchoring elements 27, 28 preferably decreases in the direction of the tip of the boot. Furthermore, the anchoring elements 27, 28 projecting upwards on the longitudinal sides of the outsole 3 substantially secure the lateral support of the inner boot 6 versus the outsole 3 as well. In particular, the anchoring elements 27, 28 also represent a type of lateral stop element for the inner boot 6, which may prevent the inner boot 6 from slipping off sideways versus the outsole 3 to the greatest possible extent, or allow it to withstand the displacement forces occurring while the sports boot 1 is being used. On that account, the sports boot 1 is particularly suited also for exercising the so-called skating, because increased lateral forces occur between the foot, or the inner boot 6 and the outsole 3 in conjunction with said long-distance sports technique, and because the stocking-like coat or overstocking 6 on the latticed or net-like support structure 12, viewed per se, exerts hardly any holding force on the inner boot 6, and due to its softness or yieldingness, the latter could not or only inadequately absorb the lateral forces and/or vertical forces and/or longitudinal forces occurring between the inner boot 6 and the outsole 3. The latticed or net-like support structure 12 is primarily responsible for absorbing the lateral, vertical and/or longitudinal forces in any case.

It is evident from FIGS. 3 and 4, furthermore, that the latticed or net-like support structure may additionally contain in the rearward and/or front end sections of the outsole 3 additional elements for safely absorbing mainly the displacement forces occurring between the inner boot 6 and the outsole 3 parallel to the longitudinal axis 19 of the boot and vertically to the support surface 24. In particular, with respect to the longitudinal expanse to the support surface 24, in its rear third, i.e. in the heel section of the support surface 24, a heel pressure plate 32 may be formed for admitting pressure to the rear heel section. In this connection, such a heel pressure plate 32 is provided for admitting pressure to the heel section preferably below the Achilles tendon. Thus the heel pressure plate 32 counteracts lifting off of the foot or inner boot 6 versus the support surface 24 on the outsole 3. In addition, said heel pressure plate 32 counteracts displacement of the foot or inner boot 6 in the direction toward the rear, so that owing to the heel pressure plate 32, the inner boot 6 can not, or only hardly slip off toward the rear versus the support surface 24. Said heel pressure plate 32 is preferably comprised of a central, vertically extending holding bridge 33 connected with the outsole 3, and two pressure distribution wings 34, 35 laterally projecting from said holding bridge. In this connection, the holding bridge 33 for the pressure distribution wings 34, 35 is secured on the rear end of the outsole 3, for example injection-molded thereto, or connected with the outsole 3 in some other manner, and substantially extends upwards perpendicularly to the support surface 34 like a column. The holding bridge 33 for the pressure distribution wings 34, 35 may be preferably designed in this connection in the form of a ribbon or strip, and extends approximately in the direction of the top edge of the inner boot 6. The two lateral pressure distribution wings 34, 35 on the holding bridge 34 are provided for resting on the side sections of the heel or inner boot 6 within the area around the heel. The formation of a relatively thin holding ridge 33 on the heel pressure plate 32 has the advantage that with the lacing system 14 loosened, the heel pressure plate 32 can be pressed relatively far to the rear, permitting the inner boot 6 to be effortlessly removed or inserted versus the latticed or net-like support structure 12. Instead of forming a narrow holding bridge 33 for the pressure distribution wings 34, 35 of the heel pressure plate 32, it is possible also to form a type of film hinge, or some other weakened section such as, for example at least one lateral cut in the area of transition between the heel pressure plate 32 and the outsole 3 connected thereto. Such a holding element 36 between the heel pressure plate 32 is provided in any case for connecting the rear end of the outsole 3 with the heel pressure plate 32 with tensile strength, so that relative movements between the outsole 3 and the heel pressure plate 32 in the vertical direction relative to the support surface 24 are prevented from occurring to the greatest possible extent, but made possible in the forward and rearward directions when the latticed or net-like support structure 12 has been loosened, or is inactive. The heel pressure plate 32 thus assures, among other things, a good fit of the heel or heel section of the inner boot 6 in the latticed or net-like support structure 12.

Furthermore, it is useful if, with respect to the longitudinal expanse of the support surface 24, or with respect to the longitudinal axis 19 of the boot, in the rear third of the support surface 24, or in the heel section of the outsole 3, an additional anchoring element 37, 38 for the lacing system 14 is secured on the outsole 3 on each of the two sides of the longitudinal axis 19 of the boot, Such additional anchoring elements 37, 38 for the lacing system 14 may be formed by ribbon- or strip-like elements as well, or by the aforementioned ribbon elements 13. Said ribbon elements 13 made of a flexible fabric or plastic with the highest possible dimensional stability, at least have the highest possible tensile strength or tensile rigidity. Said ribbon elements or anchoring elements 37, 38 are preferably flexible or yielding transversely to the longitudinal direction, or transversely to the longitudinal axis of the boot. Said two additional anchoring elements 37, 38 may be referred to or viewed as components of the latticed or net-like support structure 12. Said two additional, heel-like anchoring elements 37, 38 form reversing devices 30 for the pulling element 15 as well. In this connection, such reversing elements may be formed by loops of the strip-like ribbon elements 13 themselves, or by separate lacing elements 31 such as, for example hooks or eyes in the end sections of the ribbon elements 13 facing away from the outsole 3. The two additional, heel-side anchoring elements 37, 38 preferably have those reversing devices 30 that are disposed closest to the ends, particularly the tying ends 39, or lashing ends of the string- or cord-like pulling element 15. In the tensioned condition, also the heel-side or rearward anchoring elements 37, 38 project by about 2 to 8 cm beyond the support surface 24. It is useful if the reversing devices 30 of the two additional anchoring elements 37, 38 are positioned within the close range below the ankles of the foot after the lacing system 14 has been pulled tight. In this connection, the heel-side anchoring elements 37, 38 may be formed also by a relatively yielding fabric ribbon with low dimensional stability, since they can be pulled upwards beyond the tying ends 39 of the pulling element 15 in any case, and thus do not make it more difficult to insert the inner boot 6.

If necessary, the two additional or heel-side anchoring elements 37, 38 may be connected with each other via a connecting element 40 that is guided curved around the rear heel section. Said connecting element 40 between the two heel-side or ankle-side anchoring elements 37, 38 thus extends around the heel section, or curved around the rear section of the Achilles tendon.

In this connection, the connecting element 40 may be connected with or secured on the lateral edge sections, particularly on the ends of the pressure distribution wings 34, 35. Alternatively, it is possible also to form the connecting element 40 as one single piece, and to guide it around the outer side of the heel pressure plate 32, whereby the ribbon-like connecting element 40 rests on the outer side of the heel pressure plate 32, or outer sides of the pressure distribution wings 34, 35, as it is evident, e.g. from FIG. 3. The connecting element 40 guided around the rear heel section is substantially extending with a horizontal alignment.

If necessary, the vertical spacing 41 between the ribbon-like connecting element 40 extending curved, and the support surface 24 on the outsole 3 may be changeable or fixable or adjustable as needed. In particular, provision may be made for an adjustment means, with which the extension, particularly the vertical extension of the connecting element 40 can be individually changed. The direction of the force o direction of the pressure distribution of the heel pressure plate 32 can be changed in a simple manner, or adapted to the given conditions or boot shapes or also foot forms. Said adjustment means 42 for the vertical spacing 41 of the connecting element 40 may comprise at least two or more ribs 43 or recesses 44, which are spaced from one another on the external side of the heel pressure plate 32. With said adjustment means 42 it is possible to particularly change the vertical position or extension of the preferably ribbon-shaped connecting element 40, and to hold it positioned in the adjusted nominal position. The design of the ribs 43 or recesses 44 represents in this connection a particularly simple, yet effective adjustment means, permitting to change the adjustment without tools. In particular, the tensile effect of the heel pressure plate 32 can be changed in this way, and/or the direction of the tension exerted by the connecting element 40 on the heel pressure plate 32 can be individually adapted. Owing to such variable two-point support or two-point mounting for each of the two additional anchoring elements 37, 38 provision is made for optimal adjustment of the heel pressure plate 32, and also for optimal reversal for the pulling element 15 of the lacing system 14. In particular, with the vertical variability of the connecting element 40, it is possible also to achieve a vertical adjustment of the additional heel-side or ankle-side anchoring elements 37, 38.

For further improving the holding effect on the inner boot 6 versus the outsole 3, it is possible according go an advantageous design to arrange a toe cap 45 in the front end section of the support surface 24. Such a toe cap 45, which substantially surrounds the front end section of the inner boot 6 or the area around the toes, is connected with the outsole 3 or secured on the outsole 3, particularly glued, sewed or the like to the latter. Said toe cap 45 extends like a cap over the tip of the inner boot 6, starting from the front end of the outsole 3, whereby the top edge 46 of the toe cap 45 ends in front of the roots of the toes or ball of the foot. It is assured in this way that the toe cap 45 will not hinder flexing movements in the bending zone 4, or movements only marginally so. In particular, said toe cap 45, or such a cavity-like receptacle for the tip of the inner boot 6 ensures that flexing of the outsole 3, or of the shaft 2 at the level of the ball of the foot, or at the level of the transition between the roots of the toes and the forefoot, is impeded as little as possible. Owing to such a toe cap 5, which is relatively short based on the overall longitudinal expanse of the support surface 24, the flexing or flexibility behavior or sports boot 1 is mainly determined by the outsole 3 or the inner boot 6.

The latticed or net-like support structure 12 for the inner boot 6, and the toe cap 45 for holding he tip of the inner boot, on the other hand, have only relatively minor or hardly any influence on the rigidity or flexing behavior of the sports boot 1.

The toe cap 45 mainly prevents lift-off movements of the tip section of the inner boot 6 from occurring versus the support surface 24. In addition, the toe cap 45 is capable of absorbing also those forces that occur between the inner boot 6 and the outsole 3 in the direction of the longitudinal axis 19 of the boot. The lateral sections of the toe cap 45 are capable also to a certain extent to prevent deviating movements from occurring between the tip of the inner boot and the outsole 3, such movements extending transversely to the longitudinal axis 19 and approximately parallel to the support surface 24. For this purpose, it is only required that the front end or tip section of the inner boot 6 fills out the toe cap 455 substantially free of play when the inner boot 6 is inserted in the latticed or net-like support structure 12.

According to an advantageous further development, the instep or foot pressure plate 29 may be connected with the toe cap 45 via a cord- or ribbon-shaped connection element 47. In this conjunction, such a connection element 47 represents a longitudinal positioning device for the inlet or foot pressure plate 29 in the direction of the longitudinal axis 19 of the boot. In particular, it is possible through a predefined length of the connection element 47 between the toe cap 45 and the instep or foot pressure plate 29 to ensure that the instep or foot pressure plate 29 will not slide along the instep too far upwards, or is limited in its movement in the direction of the instep, or direction toward the transition between the foot and the leg. The connection element 47 may have a predetermined length in this conjunction, or is length may be variable so as to be able to individually position the instep or foot pressure plate 29 in different positions on the instep, or in different positions on the forefoot, thus on top of the metatarsal bone. The connection element 47 may be formed in this connection by a strip of plastic or textile fabric with tensile strength that is, however, flexible or yielding transversely to its longitudinal axis. In this connection, the connection element 47 having the highest possible tensile strength, yet being relatively flexible, may be glued and/or sewn to one end of the toe cap 45, and glued or sewn to the other end, or attached to the latter by injection molding. By changing the anchoring position of the at least one end section of the connection element 47, and/or by changing the overlapping width of a two-component connection element 47, it is possible to vary or individually change the spacing between the toe cap 45 and the instep or foot pressure plate 29 in a simple manner. However, the optional connection element 47 may be formed also by the pulling element 15 of the lacing system 14, or by an independent lacing connecting the toe cap 45 with the instep or foot pressure plate 29.

Figure 6:
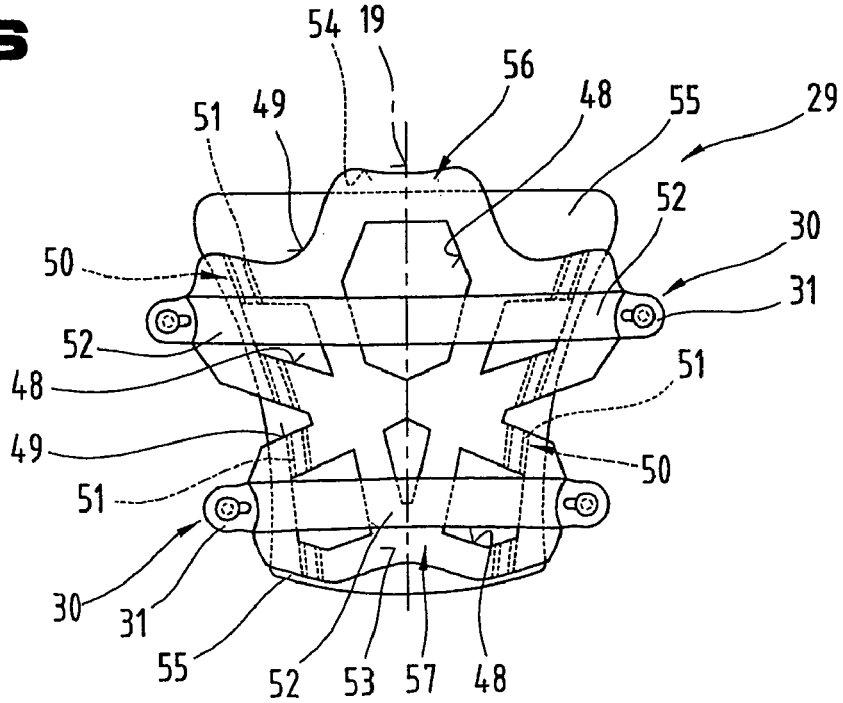
FIG. 6 is a top view and schematic representation of a preferred embodiment of an instep or heel pressure plate of the sports boot.

It is most clearly evident from FIGS. 5, 6 that the instep or foot pressure plate 29 preferably has a plurality of break-throughs 48 and/or cuts 49. In particular, the instep or foot pressure plate 29 is preferably embodied in the form of a net or lattice as well.

This assures, on the one hand, the lowest possible weigh of the instep or foot pressure plate 29 without substantially impairing its stability. However, a special advantage of the break-throughs 48 and/or cuts 49 of the instep or foot pressure plate 29 lies in that the instep or foot pressure plate 29 is capable of resting against, or attaching itself snuggly to the top side of the inner boot 6 as exactly as possible, and as free as possible of pressure points. In particular, a fixation of the inner boot 6 that is as free of play as possible is achieved in this manner, and pressure points are avoided in this way to the greatest possible extent, because the tensioning forces exerted by the lacing system 14 are distributed as uniformly as possible over the instep or metatarsal bone of the forefoot. The net-like or latticed instep or foot pressure plate, therefore, assumes a pressure distribution function versus the inner boot 6, on the one hand. On the other hand, and, when the lacing system 14 is loosened, the instep or foot pressure plate 29, which is supported in a substantially floating manner, permits the inner boot 6 to be comfortably or effortlessly inserted in the latticed or net-like support structure 12, and to be removed therefrom again without problems when needed.

It is evident from FIG. 6, furthermore, that the instep or foot pressure plate 29 may have the weakened sections 50 at its upper or bottom side, or on the two flat sides. Said weakened sections 50 are preferably formed by the rivets 51 or by some other material weakening, as it has been indicated by broken lines. The weakened sections 50 are preferably arranged in the two lateral edge sections of the instep or foot pressure plate 29, as it is evident from FIG. 6. That is to say, the weakened sections 50 in the instep or foot pressure plate 29 are arranged relatively closely to the reversing devices 30. In the exemplified embodiment shown, four reversing devices 30 are arranged for the lacing system 14 (FIG. 3), whereby said reversing devices 30 are formed by the lacing elements 31 with friction-reducing rollers for the pulling element 15 (FIG. 3). However, the reversing devices 30 or lacing elements 31 may be formed also by simple hooks, or may be defined by the breakthroughs 48, or by edge-side bridges in the instep or foot pressure plate 29.

Provision may be made for at least one connection ribbon 52 for securing the lacing elements 31 in a particularly tear-proof manner. Such a connection ribbon 52 preferably connects two reversing devices 30 or lacing elements 31 arranged on oppositely disposed edge sections of the instep or foot pressure plate 29, as it is evident from FIG. 6. The reversing devices 30 or lacing elements 31 are sewn or glued to, or injection-molded onto such a connection ribbon 52, which is preferably formed by a ribbon of a textile fabric. The connection ribbons 52 between oppositely disposed lacing elements 31 preferably rest on the top side 53 of the instep or foot pressure plate 29. Such preferably textile connection ribbons 52 may be glued or sewn also to the instep or foot pressure plate 29 disposed underneath, in order to increase the tensile strength, or tearing strength of the instep or foot pressure plate 29, which is preferably made of plastic. Said connection ribbons 52, which substantially extend transversely to the longitudinal axis of the boot, may form at their two ends the simple reversing devices 30 for the pulling element 15 of the lacing system 14 (FIG. 3). In particular, the ends of the connection ribbons 52 can be formed into loops, through which the pulling element 15 is guided (FIG. 3). Viewed from the top, the instep or foot pressure plate 29 is substantially V- or trapeze-shaped, as it is evident from FIG. 6.

According to a preferred embodiment, at least one cushioning 55 is formed on the bottom side 54 of the instep or foot pressure plate 29. Said cushioning 55 consists of, for example a layer of softly elastic foam plastic, and prevents pressure points in points on the top side of the inner boot 6, or on the upper side of the forefoot. The cushioning 55 is preferably glued or sewn to the bottom side 54 of the latticed or net-like foot pressure plate 29. In at least some marginal sections, the cushioning 55 preferably extends beyond the lateral edges of the instep or foot pressure plate 29. In the exemplified embodiment shown, the cushioning 55 extends beyond the front—based on the longitudinal axis 19 of the boot—or the front end section 57 of the instep or front pressure plate 29. It was found go be favorable if the cushioning 55 also extends over the rear end section 56 of the instep or foot pressure plate 29 in order to avoid stronger pressure points.

It is evident most clearly from FIG. 5 that the instep or foot pressure plate 29 is arched, viewed in the cross section, or transversely to the longitudinal axis 29 of the boot; i.e. that the two lateral edge sections with the reversing devices 30 are comparatively positioned lower than the central or middle section of the instep or foot pressure plate 29. It is important in this connection that the arch or curvature of the instep or foot pressure plate 29 is predefined, so that said curvature or arch can be substantially maintained in the unstressed condition. However, the preformed instep or foot pressure plate 29 is flexible or bendable to such a degree that said arch or curvature is variable as tensioning or tensile forces are being applied by the lacing system 14. In particular, said arch is reducible and/or increasable in order to obtain the best possible adaptation of the instep or foot pressure plate 29 to the top side of the inner boot 6, or to the arch of the forefoot, or the back of the foot.

The predefined shape or predefined contour of the instep or foot pressure plate 29 is preferably obtained with suitable injection-molded components. The instep or foot pressure plate 29, and the lateral anchoring elements 27, 28 for the cage-like or latticed or net-like support structure 12, are preferably formed by injection-molded components consisting of an elastically yielding and rebounding plastic. Said elements are preferably formed by a hard plastic with elastomeric properties, i.e. that said elements are formed by plastic components with tensile strength having an adequately high modulus of elasticity, so that they can be deformed without fracturing, or without becoming fragile due to such deformation. The cage-like or latticed, preformed support structure 12 for the inner boot 6 consists of at least one quasi floatingly supported instep or foot pressure plate 29, and the lateral anchoring elements 27, 28, as this is evident most clearly from FIG. 5.

Furthermore, it is useful if the instep or foot pressure plate 29 extends curved, or is preformed arched also with respect to the longitudinal axis 19 of the boot. In particular, based on the support surface 24 for the inner boot 6 on the outsole 3, the instep or foot pressure plate is convex, and concave or curved downwards based on the longitudinal axis 19 of the boot, i.e. that based on the longitudinal axis 19 of the boot, the instep or foot pressure plate has the upwardly extending or upwards pointing front and rear end sections 56, 57, as it is evident when viewing FIGS. 5 and 6 jointly. Said quasi convex bottom side 54 of the instep or foot pressure plate 29 avoids pressure or chafing points in the flexing or deformation zones of the forefoot, so that the wearing comfort of the sports boot 1 can be substantially increased. The instep or foot pressure plate 29 is ideally formed also three-dimensionally, i.e., the instep or foot pressure plate 29 is arched, curving around each of the three dimensional axes. In this connection, the three-dimensionally contoured instep or foot pressure plate 29 substantially contributes to the wearing comfort, since pressure or chafing points are avoided in the beat possible way, on the one hand, and, in addition, an ideal adaptation to the inner boot 6, and also the best-possible distribution of the occurring tensioning or tensile forces are achieved, on the other hand.

According to a preferred embodiment, the instep or foot pressure plate 29, viewed from the top, may substantially have the form of an "X", as it is most clearly evident from FIG. 6. A reversing device 30 is arranged in this connection on each of the ends of the X-shaped instep or foot pressure plate 29, so that a total of four pulling of anchoring points are available for the pulling element 15 of the lacing system 14.

For the sake of good order, it is finally pointed out that in the interest of superior understanding of the structure of the sports boot 1, the latter or its components are partly shown untrue to scale and/or enlarged and/or reduced.

The problem on which the independent inventive solutions are based are disclosed in the specification.

Above all, the individual embodiments shown in FIGS. 1, 2; 3, 4, 5; 6 may form the object of independent solutions as defined by the invention. The relevant problems and solutions as defined by the invention are specified in the detailed descriptions of said figures.

LIST OF REFERENCE NUMBERS

| | |
|---|---|
| 1 | Sports boot |
| 2 | Shaft |
| 3 | Outsole |
| 4 | Bending zone |
| 5 | Reinforcement |
| 6 | Inner boot |
| 7 | Foam plastic |
| 8 | Coating |
| 9 | Cushioning |
| 10 | Collar (elastic) |
| 11 | Insole or outsole |
| 12 | Latticed or net-like support structure |
| 13 | Ribbon element |
| 14 | Lacing system |
| 15 | Pulling element |
| 16 | Overstocking |
| 17 | Surface |
| 18 | Closing means |
| 19 | Longitudinal axis of boot |
| 20 | Sight window |
| 21 | Cutout |
| 22 | Top material |
| 23 | Sub-material |
| 24 | Support surface |
| 25 | Inner side of boot |
| 26 | Outer side of boot |
| 27 | Anchoring element (inside) |
| 28 | Anchoring element (outside) |
| 29 | Instep or foot pressure plate |
| 30 | Reversing device |
| 31 | Lacing element |
| 32 | Heel pressure plate |
| 33 | Holding bridge |
| 34 | Pressure distribution wing |
| 35 | Pressure distribution wing |
| 36 | Holding element |
| 37 | Anchoring element (heel-side) |
| 38 | Anchoring element (heel-side) |
| 39 | Tying end |
| 40 | Connecting element |

-continued

| | |
|---|---|
| 41 | Spacing |
| 42 | Adjustment means |
| 43 | Rib |
| 44 | Recess |
| 45 | Toe cap |
| 46 | Top edge |
| 47 | Connecting element |
| 48 | Breakthrough |
| 49 | Cut |
| 50 | Weakened section |
| 51 | Groove |
| 52 | Connection ribbon |
| 53 | Top side |
| 54 | Bottom side |
| 55 | Cushioning |
| 56 | End section (rear) |
| 57 | End section (front) |

The invention claimed is:

1. A sports boot for walking or cross-country skiing, with a flexible shaft receiving the foot, and a reinforcement surrounding the shaft on its external side by sections and connected with an outsole, wherein the shaft is formed by a cushioned inner boot consisting of foam plastic and a coat of fabric or another material compatible with the human skin; that the reinforcement is formed by a latticed or net-shaped support structure for the inner boot, and by flexible ribbon elements made of plastic or textiles with high tensile strength, said ribbon elements resting against external part sections of the inner boot, or surrounding the inner boot on its external side within part sections, the latticed or net-shaped support structure being variable by means of a lacing system with respect to its defining or receiving volume; and that a soft overstocking is formed, the latter enclosing the latticed or net-shaped support structure at least by sections, and is formed for sealing or shutting off the interior of the boot against external environmental influences; wherein the latticed or net-shaped support structure is comprised of at least one anchoring element formed on the inner side of the boot, at least one anchoring element is formed on the outer side of the boot, and at least one instep or foot pressure plate at least approximately bridges the lateral anchoring elements; at their ends facing away from the upper support surface of the outsole, the lateral anchoring elements are provided with reversing devices for a string- or lace-shaped pulling element of the lacing system, or form such reversing devices; at least one reversing device for a string- or lace-shaped pulling element for the lacing system is formed and arranged in each of the lateral edge sections of the instep or foot pressure plate associated with the anchoring elements; the lacing system connects the instep or foot pressure plate with at least one of the lateral anchoring elements via a string- or lace-shaped pulling element in a zigzag or undulated form; the latticed or net-shaped support structure is comprised of at least two components and expandable transversely to the longitudinal axis of the boot, and its delimiting or receiving volume is increasable, so that the inner boot can be lifted from the latticed or net-like support structure and removed therefrom as required; and the lateral anchoring elements are provided with adequate rigidity so as to project upwards in an unstressed condition substantially perpendicularly to a support surface for the inner boot.

2. The sports boot according to claim 1, wherein during walking movements, the inner boot is supported with limited relative mobility relative to the upper support surface on the outsole and relative to the ribbon elements.

3. The sports boot according to claim 1, wherein the lacing system connects the lateral anchoring elements and the instep or foot pressure plate with each other in such a manner that the receiving volume delimiting said elements is reducible when the lacing system is pulled tight.

4. The sports boot according to claim 1, wherein for varying the spacing between at least one of the lateral anchoring elements and the instep or foot pressure plate resting on the top side of the inner boot, the lacing system is arranged laterally of the instep or foot pressure plate bridging the foot.

5. The sports boot according to claim 1, wherein in the cross-section, the instep or foot pressure plate is arched transversely to the longitudinal axis of the boot.

6. The sports boot according to claim 1, wherein based on the support surface for the inner boot on the outsole, the instep or foot pressure plate is arched in a concave form, or has end sections extending upwards vis-à-vis the center section.

7. The sports boot according to claim 1, wherein the instep or foot pressure plate has a plurality of breakthroughs or cuts, or is latticed or net-shaped.

8. The sports boot according to claim 1, wherein the instep or foot pressure plate has a plurality of weakened sections.

9. The sports boot according to claim 1, wherein the lateral anchoring elements project by about 2 to 8 cm beyond the support surface.

10. The sports boot according to claim 1, wherein two lateral anchoring elements in the center third of the longitudinal extension of the support surface are connected with the outsole.

11. The sports boot according to claim 1, wherein the instep or foot pressure plate and the lateral anchoring elements are formed by an injection-molded components consisting of an elastic and rebounding plastic.

12. The sports boot according to claim 1, wherein with respect to the longitudinal extension of the support surface, in its rear third or in the heel section an additional anchoring element is secured on the outsole on each of the two sides of the longitudinal axis of the boot.

13. The sports boot according claim 12, wherein the two additional anchoring elements are connected with one another via a curved connection element guided curved around the rear heel section.

14. The sports boot according to claim 1, wherein a heel pressure plate for admitting pressure to the rear heel section is formed in the section below the Achilles tendon.

15. The sports boot according to claim 14, wherein the heel pressure plate is connected with tensile strength to the rear end of the outsole via a holding element.

16. The sports boot according to claim 13, wherein the connection element is connected with the lateral edge sections of the heel pressure plate, or designed in the form of one single piece, and guided around the external side of the heel pressure plate.

17. The sports boot according to claim 13, wherein the vertical spacing between the curved connection element and the support surface on the outsole is changeable or fixable or adjustable.

18. The sports boot according to claim 17, wherein an adjustment means for the connection element comprises ribs and recesses on the external side of the heel pressure plate spaced from one another in the vertical direction.

19. The sports boot according to claim 14, wherein the heel pressure plate is formed by a central, vertically extending holding bridge connected with the outsole, and two pressure distribution wings laterally protruding therefrom.

20. The sports boot according to claim 1, wherein a toe cap is arranged in the front end section of the support surface, and connected with the outsole.

21. The sports boot according to claim 20, wherein the toe cap is connected with the instep or foot pressure plate via a ribbon-shaped connection element.

22. The sports boot according to claim 1, wherein a cushioning is secured on the bottom side of the instep or foot pressure plate.

23. The sports boot according to claim 1, comprising overstocking formed by a liquid-tight or liquid-repelling, highly flexible and thin-walled top material and a textile base material.

24. The sports boot according to claim 23, wherein the overstocking is coated with an elastomeric plastic.

25. The sports boot according to claim 23, wherein the top material and the base material are connected or sewn to each other only by sections.

26. The sports boot according to claim 23, wherein the overstocking is substantially liquid-tightly joined with the outsole.

27. The sports boot according to claim 23, wherein a sight window of transparent or translucent plastic is inserted in a cutout of the overstocking.

28. The sports boot according to claim 27, wherein the sight window is arranged in a covering section covering at least one of the lateral anchoring elements.

29. The sports boot according to claim 1, wherein the inner boot is designed as a relatively thick-walled, soft-elastic and expandable foot covering.

* * * * *